US011825277B2

(12) United States Patent
Berge

(10) Patent No.: US 11,825,277 B2
(45) Date of Patent: Nov. 21, 2023

(54) SIGNAL ACQUISITION DEVICE FOR ACQUIRING THREE-DIMENSIONAL (3D) WAVE FIELD SIGNALS

(71) Applicant: HARPEX LTD, Berlin (DE)

(72) Inventor: Svein Berge, Berlin (DE)

(73) Assignee: Harpex Audio GMBH, Berlin (DE)

( * ) Notice: Subject to any disclaimer, the term of this patent is extended or adjusted under 35 U.S.C. 154(b) by 931 days.

(21) Appl. No.: 16/644,761

(22) PCT Filed: Aug. 31, 2018

(86) PCT No.: PCT/EP2018/073501

§ 371 (c)(1),
(2) Date: Mar. 5, 2020

(87) PCT Pub. No.: WO2019/048355

PCT Pub. Date: Mar. 14, 2019

(65) Prior Publication Data

US 2021/0067870 A1 Mar. 4, 2021

(30) Foreign Application Priority Data

Sep. 7, 2017 (EP) ..... 17189904

(51) Int. Cl.

*H04R 3/00* (2006.01)
*H04R 1/40* (2006.01)
*H04S 3/00* (2006.01)

(52) U.S. Cl.

CPC ..... *H04R 3/005* (2013.01); *H04R 1/406* (2013.01); *H04S 3/002* (2013.01);
(Continued)

(58) Field of Classification Search

CPC .. H04R 3/005; H04R 1/406; H04R 2201/401; H04S 3/002; H04S 2400/15; H04S 2420/11
(Continued)

(56) References Cited

U.S. PATENT DOCUMENTS 4,156,800 A * 5/1979 Sear ..... H04R 1/406 310/322
5,742,693 A 4/1998 Elko
(Continued)

FOREIGN PATENT DOCUMENTS

WO 2011/149451 A1 12/2011
WO 2016/011479 A1 1/2016

OTHER PUBLICATIONS

Written Opinion and International Search Report for PCT/EP2018/073501 dated Oct. 29, 2018, 10 pages.
(Continued)

*Primary Examiner* — William A Jerez Lora
(74) *Attorney, Agent, or Firm* — Workman Nydegger

(57) ABSTRACT

A Signal acquisition device is described for acquiring three-dimensional wave field signals. The signal acquisition device comprises an acoustically reflective plate (PLT) comprising two planar sides facing oppositely and a two-dimensional array of inherently omnidirectional sensors (TSS) arranged on one of the two sides, characterized in that the sound recording device comprises another two-dimensional array of inherently omnidirectional sensors (BSS) arranged on the other of the two sides.

20 Claims, 8 Drawing Sheets

Figure 1:
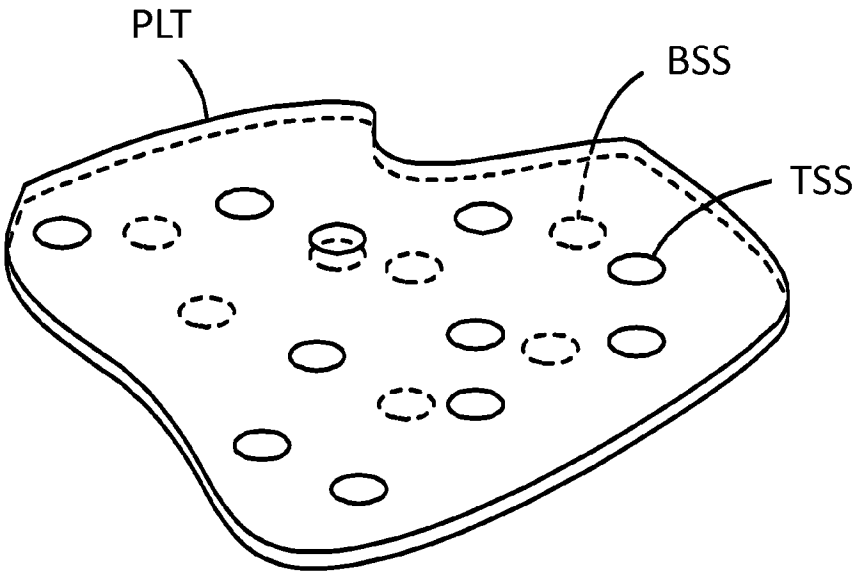

(52) U.S. Cl.
CPC .... *H04R 2201/401* (2013.01); *H04S 2400/15* (2013.01); *H04S 2420/11* (2013.01)

(58) Field of Classification Search
USPC ..... 381/26, 56, 58, 91, 113, 114, 122, 355, 381/375
See application file for complete search history.

(56) References Cited

U.S. PATENT DOCUMENTS

| | | | | |
|---|---|---|---|---|
| 2009/0052688 | A1* | 2/2009 | Ishibashi | H04R 3/12 381/92 |
| 2012/0275621 | A1 | 11/2012 | Elko | |
| 2013/0101136 | A1* | 4/2013 | McElveen | H04R 1/02 381/92 |
| 2014/0117809 | A1 | 5/2014 | Zemp | |
| 2015/0279345 | A1* | 10/2015 | Mathur | G10K 11/162 181/294 |
| 2016/0277863 | A1* | 9/2016 | Cahill | G01S 3/8083 |

OTHER PUBLICATIONS

Meyer, J.; Elko, G., "A highly scalable spherical microphone array based on an orthonormal decomposition of the soundfield, 2002", Proceedings of the IEEE International Conference on Acoustics, Speech, and Signal Processing (ICASSP, (20020000), pp. 1781-1784.

Tiete, J., et al., "SoundCompass: A distributed MEMS microphone array-based sensor for sound source localization", Sensors, (20140000), vol. 14, pp. 1918-1949.

Williams, Earl G., "Numerical evaluation of the radiation from unbaffled, finite plates using the FFT", The Journal of the Acoustical Society of America, (19830000), vol. 74.1, pp. 343-347.

Parthy, A. et al., "Acoustic holography with a concentric rigid and open spherical microphone array," 2009 IEEE International Conference on Acoustics, Speech and Signal Processing, Taipei, 2009, pp. 2173-2176.

Gupta, A., et al., "Double sided cone array for spherical harmonic analysis of wavefields," 2010 IEEE International Conference on Acoustics, Speech and Signal Processing, Dallas, TX, 2010, pp. 77-80.

* cited by examiner

SIGNAL ACQUISITION DEVICE FOR ACQUIRING THREE-DIMENSIONAL (3D) WAVE FIELD SIGNALS

The present invention relates generally to the field of signal processing and, in particular, to acquiring three-dimensional (3D) wave field signals.

BACKGROUND

In the field of signal processing, it is desirable to obtain a 3D wave field mathematical representation of the actual 3D wave field signals as such a representation enables an accurate analysis and/or reconstruction of the 3D wave field. One such mathematical representation is the 3D wave field spherical harmonic decomposition.

Several microphone array geometries, sensor types and processing methods have been proposed in order to capture and process the information required for producing such a representation. A spherical array of pressure microphones placed flush with the surface of a rigid sphere is capable of capturing information which can be transformed into a spherical harmonic decomposition of the 3D wave field. This arrangement is described in Meyer, J.; Elko, G.: *A highly scalable spherical microphone array based on an orthonormal decomposition of the soundfield,* 2002, in Proceedings of the IEEE International Conference on Acoustics, Speech, and Signal Processing (ICASSP), Orlando, FL, USA; 2002; pp. 1781-1784.

However, the low frequency limit of such an array, due to the characteristics of the radial functions associated with the spherical harmonic basis functions, is governed by the radius of the array and the desired order of decomposition, whereas the high frequency limit, due to spatial aliasing, is governed by the density of microphones on the surface of the sphere. As a consequence, the number of microphones required in such an array is asymptotically equal to the square of the desired ratio between the upper and lower frequency limits. This, combined with the practical difficulties in assembling electronics in a spherical form, makes this type of array costly to implement, particularly when a broad frequency range is required.

Some of the aforementioned problems are addressed in Parthy, Abhaya, Craig Jin, and André van Schaik: *Acoustic holography with a concentric rigid and open spherical microphone array,* 2009, in Proceedings of the IEEE International Conference on Acoustics, Speech and Signal Processing, ICASSP 2009. This paper describes an arrangement comprising several concentric spheres, the inner of which is acoustically rigid. However, the improvements that such arrays bring in terms of bandwidth come at the cost of further increased complexity in construction.

Another geometry which has been proposed is that of a planar 2D array, consisting of pressure microphones that are in principle only sensitive to the even components of the spherical harmonic decomposition and first-order microphones that are also sensitive to the odd components of the spherical harmonic decomposition. This arrangement is described in WO 2016/011479 A1. The low frequency limit of such an array is governed by the overall radius of the array. The high frequency limit is governed by the radial distance between microphones. The angular distance between microphones governs the order of spherical harmonic decomposition which can be computed. This form of array has the advantage over a spherical one that the required number of sensors, at a given order of decomposition, is only be asymptotically proportional to the ratio between the upper and lower frequency limits. It has the disadvantage, however, that it requires the use of first-order sensors. The use of standard PCB production techniques like reflow soldering is precluded due to the low temperature tolerance of the currently available low-cost first-order sensors. This problem can to some extent be alleviated by using pairs of pressure sensors in close proximity to each other as first-order sensors. However, the low-frequency first-order sensitivity of such sensor pairs is such that the low-frequency limit of the entire system would in that case be governed by the distance between sensors within each pair rather than the much larger distance between sensors at different locations in the plane. Furthermore, the theory of operation of this type of array assumes that the sensors, wiring and associated electronic components do not affect the wave field. In any real implementation, these elements would necessarily scatter the wave field to some extent, thereby reducing the accuracy of the constructed wave field representation.

Yet another geometry which has been proposed is that of a double-sided cone, where pressure sensors are placed on the intersections between a series of horizontal planes and a double-sided cone with a vertical axis. This arrangement is described in Gupta, A.; Abhayapala, T. D.: *Double sided cone array for spherical harmonic analysis of wavefields,* 2010, in Proceedings of the IEEE International Conference on Acoustics Speech and Signal Processing, ICASSP 2010. While this geometry is also capable of capturing the information necessary to obtain a spherical harmonic decomposition of the 3D wave field, the practical implementation of such a 3D structure is more challenging than implementing a 2D microphone array and the resulting structure will be less portable and robust, particularly as it needs to be acoustically open.

Scattering plates have been utilized in conjunction with microphone arrays in the past, for example, the well-known Jecklin Disk, a popular stereo recording technique. This arrangement is, however, not intended to capture 3D wave field signals or to construct a 3D wave field representation.

2D microphone arrays mounted on printed circuit boards have been constructed in the past, for example in Tiete, J.; Domínguez, F.; Silva, B. D.; Segers, L.; Steenhaut, K.; Touhafi, A. SoundCompass: *A distributed MEWS microphone array-based sensor for sound source localization.* Sensors 2014, 14, 1918-1949. This microphone array only has sensors on one side of the PCB and is only capable of producing a 2D wave field representation.

Mounting microphones on both sides of a PCB has been proposed in the past, for example in US 2012/0275621 A1. In that patent, however, the use of microphones on both sides of a PCB is only taught as a way to suppress signals due to the vibration of the PCB. It does not propose that such a microphone arrangement can be used to sense the scattered and vibration-generated fields as a way to gain 3D information about the wave field signal. Furthermore, that patent only claims the invention of double-sided surface-mounted microphone arrays on PCBs which are flexible and bent to achieve a 3D shape.

DISCLOSURE OF THE INVENTION

Disclosed are arrangements which seek to address the above problems by using two 2D sensor arrays, one on each of the two surfaces of a rigid plate to acquire the 3D wave field signals and construct the 3D wave field representation from the acquired 3D wave field signals.

In one aspect of the present invention, there is provided a signal acquisition device for acquiring three-dimensional wave field signals. The signal acquisition device comprises a wave reflective plate comprising two planar sides facing oppositely and a two-dimensional array of inherently omnidirectional sensors arranged on one of the two sides. The signal acquisition device is characterized in that the sound recording device comprises another two-dimensional array of inherently omnidirectional sensors arranged on the other of the two sides.

This allows for determining even and odd modes of the wave field by determining sums and differences between signals derived from each of the two two-dimensional arrays. Even modes of an incident wave field cause no scattering or vibration, and can be observed as an identical pressure contribution on the two opposing sides of the plate. The odd modes cause both scattering and vibration VIB of the plate, both of which can be observed as opposite pressure contributions on the two opposing sides of the plate. At moderate sound pressures, all of these processes can be accurately modelled as linear and time-invariant, which facilitates their inversion and the eventual estimation of the incident wave field based on the measured pressure on the two surfaces.

In a preferred embodiment, the shape of the plate is approximately circularly symmetric, such as a circular disc.

Then scattering and vibration of the wave filed are separable into an angular part and a radial part, where the angular part is equal to that of the incident field.

Said sensors can be placed according to any of the following placement types:

a. a directly opposing concentric ring placement and b. a staggered concentric ring placement.

This reduces computational costs.

Said sensors can be configured for acquiring at least one of acoustic signals, radio frequency wave signals, and microwave signals.

Said plate can comprise a printed circuit board and wherein the sensors are microphones that are mounted on said printed circuit board.

The signal acquisition device can further comprise a digital signal processor configured for digitizing sensor signals acquired using the array and the another array of sensors.

The digital signal processor can be further configured for computing a 3D wave field representation of a 3D wave field by multiplying a matrix of linear transfer functions with a vector consisting of the digitized sensor signals.

The matrix of linear transfer functions can further be decomposed into a product of a multitude of block-diagonal matrices of transfer functions. The digital signal processor can be configured for multiplying each of said block-diagonal matrices with said vector of 3D wave field signals in sequence.

The signal acquisition device can further comprise means for measuring a speed of sound wherein the digital signal processor is configured for altering said matrix of linear transfer functions in accordance with said speed of sound.

The digital signal processor can comprise a field-programmable gate array.

The signal acquisition device can further comprise at least one image acquisition system located at the centre of the sensor array, each of said image acquisition systems comprising a lens and an image sensor, said image sensor characterized in that it is co-planar with the plate.

Another aspect concerns a method for constructing a three-dimensional (3D) wave field representation of a 3D wave field using a signal acquisition device according to the invention. Said wave field representation consists of a multitude of time-varying coefficients and said method comprises:

a. acquiring sensor signals using the array and the another array of sensors;

b. digitizing the acquired sensor signals; and c. computing a 3D wave field representation of a 3D wave field by multiplying a matrix of linear transfer functions with a vector consisting of the digitized sensor signals.

In a preferred embodiment, step c comprises:

obtaining a response matrix H(k) of the sensors to each of a plurality of spherical harmonic modes, obtaining an encoding matrix E(K) by inverting the response matrix H(k), obtaining bounded transfer functions T(k) E(k) by filtering elements of the encoding matrix E(K) using high-pass filters and obtaining time-domain convolution kernels h(t) by converting the bounded transfer functions T(k) E(k) using an inverse Fourier transforms.

Said multiplication with said matrix of linear transfer functions can be performed by decomposing said matrix of linear transfer functions into a product of a multitude of block-diagonal matrices of linear transfer functions and multiplying each of said block-diagonal matrices with said vector of 3D wave field signals in sequence.

The method can include a step for measuring a speed of sound and a step for altering said matrix of linear convolution filters in accordance with said speed of sound.

The constructed 3D wave field representation can be used for any of the following applications:

a. Active noise cancellation;

b. Beamforming;

c. Direction of arrival estimation; and d. Sound recording or reproduction.

Preferred frequency ranges for acoustic wave signal acquisition are 20 Hz to 1 GHz, more preferred 20 Hz to 100 MHz, more preferred 20 Hz to 1 MHz, more preferred 20 Hz to 20 kHz and most preferred 100 Hz to 10 kHz.

Preferred frequency ranges for electro-magnetic wave signal acquisition are 300 MHz to 750 THz, more preferred 300 MHz to 1 THz, more preferred 1 GHz to 100 GHz, more preferred 2 GHz to 50 GHz and most preferred 5 GHz to 20 GHz.

The plate preferably reflects more than 10% of the energy of the part of a plane wave in the range of frequencies which impinges on it at normal angle, more preferably more than 20%, more preferably more than 30%, more preferably more than 40% and most preferably more than 50%.

All sensors are preferably designed to generate signals which are actively processed.

Preferably the thickness of the plate is between 0.1 mm and 10 mm, more preferred between 0.5 and 5 mm, more preferred between 0.2 mm and 4 mm, more preferred between 1 mm and 3 mm, and most preferred between 1.25 mm and 2 mm.

Preferably the major dimension of the plate is in the range of 10000 mm to 30 mm, more preferably 500 mm to 60 mm, more preferably 250 mm to 120 mm, and most preferably 200 mm to 150 mm. The major dimension should be at least $\lambda N/2$, where $\lambda$ is the longest wavelength of interest in the surrounding medium and N is the highest degree and order of spherical harmonic of interest.

The major dimension is preferably meant to be the largest possible distance between two points on the edge of the plate.

Preferably at least more than 50% of all sensors of the signal acquisition device are formed on the wave-reflective plate, more preferred more than 60%, more preferred more than 70%, more preferred more than 80%, more preferred more than 90%, and most preferred all sensors.

Preferably the sensors formed on the plate are in direct contact with the plate or sensors which are indirectly connected to the plate e.g. via a holder or other components in between the sensors and the plate, wherein the connection is a rigid connection.

Preferably the plate is formed as one planar and rigid plate.

Rigid is preferably defined as the material having a flexural rigidity greater than $2\times10^{-4}$ Pa*m$^3$, more preferred greater than $10^{-3}$ Pa*m$^3$, more preferred greater than $10^{-2}$ Pa*m$^3$, more preferred greater than 0.1 Pa*m$^3$ and most preferred greater than 0.25 Pa*m$^3$.

The plate preferably has a uniform thickness extending over its entire lateral dimension.

The plate is also preferably formed of a uniform material or a material with a uniform rigidity coefficient over its entire lateral extend.

Preferably the plate is acoustically hard in the range of frequencies.

Preferably the definition of acoustically hard is that the characteristic specific acoustic impedance of the material differs by a factor of more than 100 from that of the surrounding medium, in one direction or the other.

Advantageous embodiments of the invention are described in the dependent claims and/or are specified in the following description of exemplary embodiments of the invention.

DRAWINGS

Figure 2:
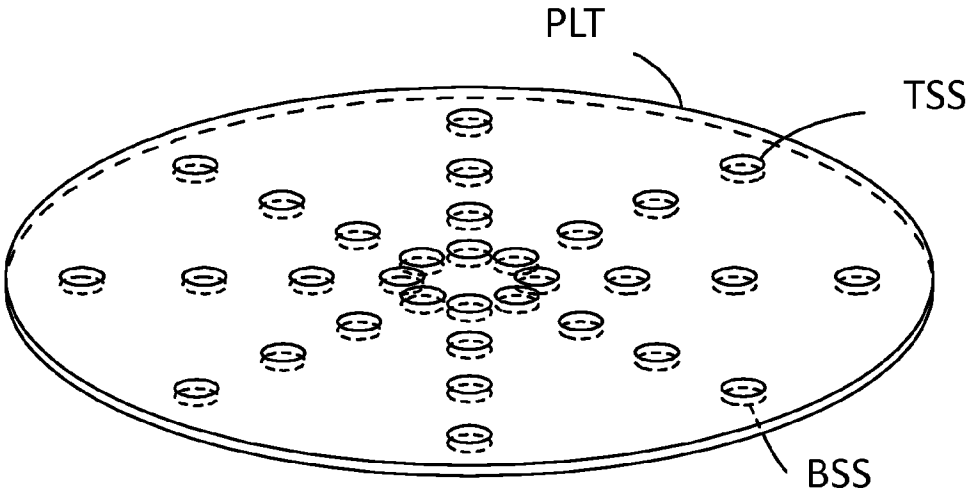
Figure 3:
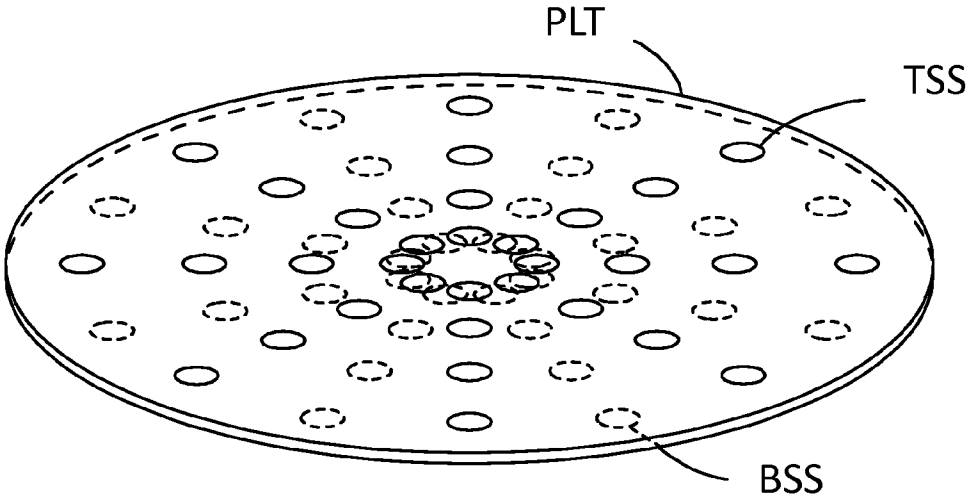
Figure 4:
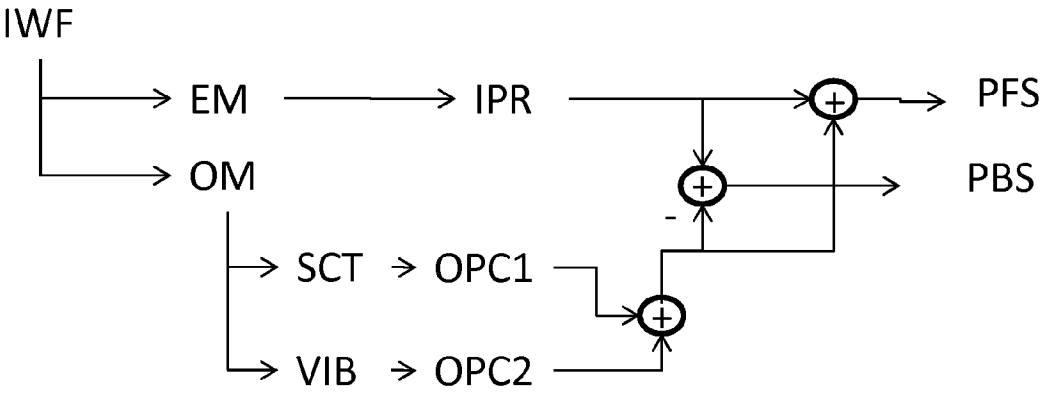
Figure 7:
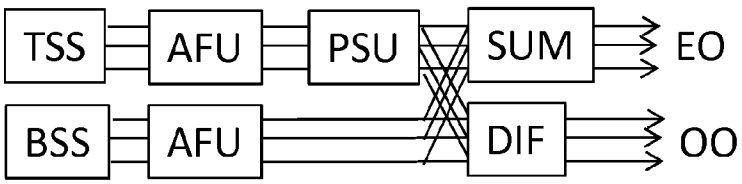
Figure 5:
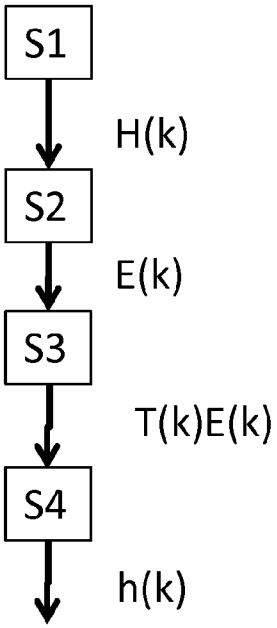
Figure 6:
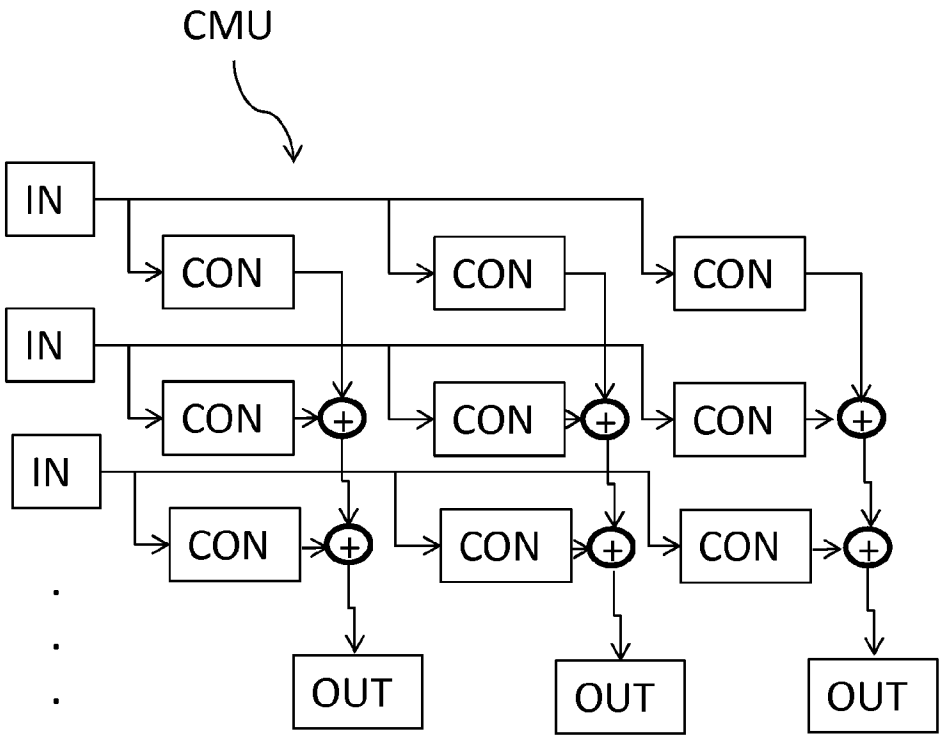
Figure 8:
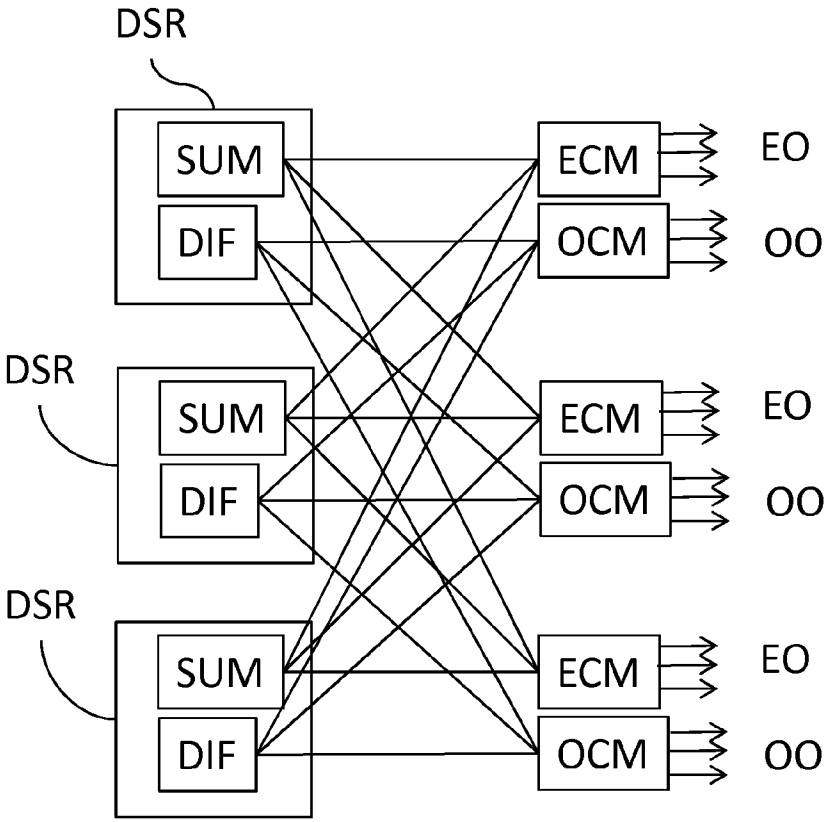
Figure 9:
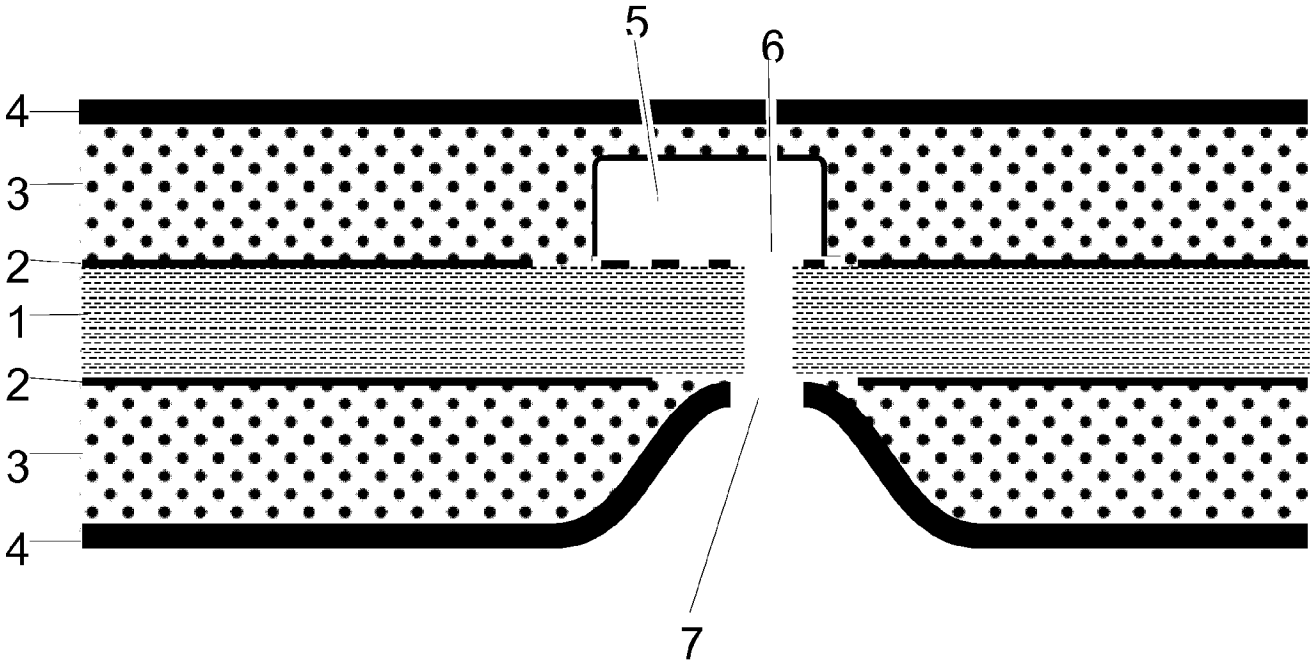

The exemplary embodiments of the invention are described below with reference to the figures. It shows, FIG. 1 a first exemplary embodiment of the invention;

FIG. 2 a second exemplary embodiment of the invention;

FIG. 3 a third exemplary embodiment of the invention;

FIG. 4 a physical model of a system on which embodiments of the invention is based;

FIG. 5 an exemplary embodiment of the method according to the invention;

FIG. 6 a convolution matrix unit as comprised in some exemplary embodiments of the invention;

FIG. 7 an exemplary embodiment of the method according to the invention applied to a single double-sided ring; and FIG. 8 an exemplary embodiment of the method according to the invention applied to double-sided rings of different radii;

FIG. 9 a cross-section of a specific exemplary embodiment of the invention.

EXEMPLARY EMBODIMENTS

FIG. 1 shows a signal acquisition device according to a first exemplary embodiment of the invention.

The signal acquisition device of FIG. 1 is configured for acquiring three-dimensional (3D) wave field signals. The signal acquisition device of FIG. 1 comprises a wave reflective plate PLT. The Plate PLT comprises two planar sides facing oppositely. A two-dimensional array of sensors TSS is arranged on one of the two sides of the plate PLT, the top surface of plate PLT. The signal acquisition device of FIG. 1 further comprises another two-dimensional array of sensors BSS arranged on the other of the two planar sides of the plate PLT, the bottom surface of the plate PLT.

Specific Embodiment

In a specific embodiment, referring to the cross section in FIG. 9, the invention comprises the following parts: A circular PCB made from the composite material FR-4 (1), with a thickness of 1.55 mm. The PCB has a diameter of 170 mm and is coated with an 18 μm thick layer of copper (2) forming the electrical connections between the components. The copper layers are in coated with a 20 μm thick epoxy-based solder mask (not shown). Electronic components are soldered to the circuit board. Each side of the circuit board is covered by a 0.5 mm thick protective sheet of polypropylene (4), deep drawn and drilled to provide openings (7) for electrical connectors (not shown) and the acoustic ports (6) of the microphones (5) and a piezo-electric transducer (not shown). The space between the circuit board and the polypropylene sheet is filled with epoxy resin (3). In this embodiment, the reflective plate consists of all the layers and components from and including the one sheet of polypropylene to and including the other sheet of polypropylene.

The major electronic components include:

An FPGA
A USB controller
A jitter cleaner
Voltage regulators
An oscillator
Microphones
A piezoelectric transducer The microphones are bottom-port type MEMS microphones, 42 of which are placed on each side of the PCB. The 42 microphones on each side are placed in the shape of a 7-armed star with 6 microphones along each arm. The angle between the arms is 360/7 degrees, and the arms on the bottom side of the PCB are offset by 360/14 degrees relative to the ones on the top side. The stars are concentric with the circuit board and the distances from the center of the stars to the acoustic ports of the microphones are the same for each arm, and are as follows:

| Microphone number | Distance/mm |
|---|---|
| 1 | 6.70 |
| 2 | 13.09 |
| 3 | 25.34 |
| 4 | 37.18 |
| 5 | 54.21 |
| 6 | 78.34 |

The piezoelectric transducer, used for speed of sound measurement, is placed at a distance of 31.26 mm from the center of the star, on an arm with microphones whose acoustic ports open on the opposite side of the PCB from the transducer.

FIGS. 2 and 3 show signal acquisition devices according to second and third exemplary embodiments of the invention.

In the signal acquisition device of FIGS. 2 and 3, the shape of the plate is approximately circularly symmetric, i.e. a circular disc.

In the signal acquisition device of FIG. 2, the sensors TSS, BSS are arranged on the opposing planar sides of the plate PLT in a directly opposing concentric ring arrangement.

In the signal acquisition device of FIG. 3, the sensors TSS, BSS are arranged on the opposing planar sides of the plate PLT in a staggered concentric ring placement.

In each of the embodiments shown in FIGS. 1-3, said sensors are configured for acquiring acoustic signals and said plate acoustically reflective. For instance, the sensors can be inherently omnidirectional, pressure-sensitive microphones.

However in other embodiments with sensors arranged as in one of FIGS. 1-3, the sensors are configured for acquiring radio frequency wave signals and/or microwave signals and said plate is reflective to radio frequency wave signals and/or microwave signals.

The plate PLT can optionally comprise a printed circuit board and wherein the sensors TSS, BSS, e.g. microphones, are mounted on said printed circuit board.

In optional enhancements of the embodiments shown in FIGS. 1-3, the signal acquisition device further comprises a digital signal processor configured for digitizing sensor signals acquired using the array and the another array of sensors.

The digital signal processor can be further configured for computing a 3D wave field representation of a 3D wave field by multiplying a matrix of linear transfer functions with a vector consisting of the digitized sensor signals.

The digital signal processor can be further configured for decomposing said matrix of linear transfer functions into a product of a multitude of block-diagonal matrices of linear transfer functions and for multiplying each of said block-diagonal matrices with said vector of 3D wave field signals in sequence.

The signal acquisition device optionally can further comprise means for measuring a speed of sound. Then the digital signal processor can be configured for altering said matrix of linear transfer functions in accordance with said speed of sound.

The digital signal processor can comprise field-programmable gate array, for instance.

In some embodiments, acquiring three-dimensional (3D) wave field signals comprises extracting coefficients of a spherical harmonic decomposition of the wave field:

$$p(\theta, \phi, r) = \sum_{l=0}^{\infty} \sum_{m=-l}^{l} x_l^m Y_l^m(\theta, \phi,) j_l(kr),$$

where p(•) is the wave field, $x_l^m$ are the coefficients, $Y_l^m(\bullet)$ are the spherical harmonic basis functions and $j_l(kr)$ are the spherical Bessel functions. The indices l and m will be referred to as the degree and the order, respectively. This equation applies to each frequency, and the time-dependence $e^{-i\omega t}$ has been omitted, as it will be throughout this description.

The basis functions have this form:

$$Y_l^m(\theta,\phi)=Ne^{im\phi}P_l^m(\cos\theta),$$

where k is the wave number $2\pi f/c$, N is a normalization constant and $P_l^m(\bullet)$ are the associated Legendre polynomials. For compactness, this description makes use of basis functions containing complex exponentials. These may be replaced by real-valued sines and cosines without substantially changing the function of the system.

Since the sensors only access the wave field in the x-y plane, evaluating $Y_l^m(\theta,\phi,r)$ in this plane is sufficient, where $$Y_l^m(\theta)=Ne^{im\phi}P_l^m(0).$$

The boundary condition for an acoustically hard plate in the x-y plane is $$\frac{\partial p}{\partial z} = 0.$$

If the incident field does not satisfy this condition, a scattered field will be generated so that the total field satisfies the boundary condition. The z-derivative of the incident wave field is $$\frac{\partial}{\partial z} Y_l^m(\theta) j_l(kr) = -(l+1-|m|)Ne^{im\phi}P_{l+1}^m(0) j_l(kr)/r.$$

Since different normalization conventions for the associated Legendre polynomials exist, this equation might contain different normalization constants depending on which normalization is chosen, but that choice will not affect the following description.

The associated Legendre polynomials have the following property:

$$P_l^m(0)=0,\ (l+m)\bmod 2=1$$

$$P_l^m(0)\neq 0,\ (l+m)\bmod 2=0$$

Spherical harmonic basis functions where l+m is even, hereafter called even spherical harmonic basis functions, therefore have non-zero values in the x-y plane, yet create no scattered field. Conversely, spherical harmonic basis functions where l+m is odd, hereafter called odd spherical harmonic basis functions, create a scattered field, but their incident field is zero in the x-y plane.

The symmetry of the problem dictates that the scattered field on the second surface of the plate is negative that on the first surface.

The microphones on both sides are collectively numbered 1 to n. Given an incident wave field corresponding to a spherical harmonic basis function $Y_l^m(\theta_j)$ of unit amplitude and frequency $f=kc/2\pi$, the response of microphone j is $$H_{l,j}^m(k)=Y_l^m(\theta_j)j_l(kr)+s_jF_l^m(\theta_j,k,r_j),$$

where $\theta_j$ and $r_j$ define the position of the microphone and $s_j$ is 1 if microphone j is on the first surface or −1 if it is on the second surface. The functions $F_l^m(\bullet)$ define the scattered field on the first surface of the plate. These functions can be estimated from measurements or calculated numerically for any plate shape using for example the method described in Williams, Earl G.: *Numerical evaluation of the radiation from unbaffled, finite plates using the FFT.* The Journal of the Acoustical Society of America 74.1 (1983): 343-347, or calculated analytically for certain special cases, including the case of a circular disc as described in Bowman, John J., Thomas B. Senior, and Piergiorgio L. Uslenghi: *Electromagnetic and acoustic scattering by simple shapes.* No. 7133-6-F. MICHIGAN UNIV ANN ARBOR RADIATION LAB, 1970.

To the extent that the plate is not perfectly rigid and fixed, vibration of the plate in the z-direction is excited by the wave field; this vibration causes acoustic radiation which is picked up by the sensors. These processes are antisymmetric about the x-y plane. Therefore, the functions $F_l^m(\bullet)$ can be constructed to include terms that depend on the vibrational modes of the plate, their coupling to the incident field and their coupling to the sensors. These terms can be estimated from measurements or calculated numerically for any plate shape using finite element analysis or calculated analytically for certain special cases. For example, the vibrational modes of circular plates are well known.

FIG. 4 summarizes the physical model of the system: An incident wave field IWF can be expressed as the sum of even modes EM and odd modes OM. The even modes cause no scattering or vibration, and can be observed as an identical pressure IPR contribution on the two opposing sides of the plate. The odd modes OM cause both scattering SCT and vibration VIB of the plate, both of which can be observed as an opposite pressure contribution OPC1, OPC2 on the two opposing sides of the plate. The contributions from these three branches are added to produce the observed pressure on the opposing sides of the plate. At moderate sound pressures, all of these processes can be accurately modelled as linear and time-invariant, which facilitates their inversion and the eventual estimation of the incident wave field based on the measured pressure on the two surfaces.

Although the functions $H_{l,j}^{m}(\bullet)$ are defined with three indices, the indices l and m can be mapped into a single index i. One possible mapping is $$i=l^2+l+m+1.$$

This way, the functions $H_{l,j}^{m}(\bullet)$ can be renamed $H_{i,j}(\bullet)$ and represent the elements of a matrix H.

The coefficients of the spherical harmonic decomposition will be similarly renamed $x_i$, and the outputs of the microphones will be called $y_j$. The response of the system to an arbitrary wave field is expressed by the following vector equation:

$$Hx=y.$$

To clarify the notation in this and the following equations, the frequency dependence is only implied. The number of elements in the vector x is in principle unbounded, but because the spherical harmonic functions and their z-derivatives vanish for large values of l and small values of r, it is possible to truncate the series to satisfy any finite error constraint for a plate and microphone array whose largest dimension is finite and for a finite frequency range. If H is non-singular, it is possible to find x using an encoding matrix E equal to the generalized inverse of H:

$$x=Ey,$$

$$E=H^{+}.$$

Advantageously but not necessarily, sensor noise can be taken into consideration when calculating E. For the sake of this description, all sensors are assumed to have the same noise $\sigma^2$, defined as $$\sigma^2=\langle y_i|^2\rangle,\ \forall i.$$

Assuming that this noise is uncorrelated between sensors, the noise in output signal $x_i$ will be $$\langle|x_i|^2\rangle=\sigma^2\sum_j|E_{i,j}|^2.$$

It is therefore important to select a plate geometry and microphone positions that minimize the magnitudes of $E_{i,j}$. For example, placing microphones on only one surface of the plate, while it does allow the decomposition into the spherical harmonic basis to be computed, it will cause more noise in the output signals than placing microphones on both surfaces. However, even with an optimal choice of these parameters, the exact generalized inverse of H may still produce more output noise than we would want. In that case, we can use an approximate encoding matrix $\tilde{E}$. A suitable trade-off between stochastic errors and systematic errors in the output signals can be made using one the following processes:

First, find the singular value decomposition of H:

$$H=U\Sigma V^{*}.$$

Second, create a diagonal matrix $\Sigma^{+}$ where the diagonal elements are equal to the inverse of the n largest elements on the diagonal of $\Sigma$, also known as the singular values of H. Set the remaining diagonal elements to zero. Use the following matrix as the approximate encoding matrix:

$$\tilde{E}=V\Sigma^{+}U^{*}.$$

This is a common way of calculating the generalized inverse of a matrix to a given numerical precision. Larger numbers n will lead to larger stochastic errors and smaller systematic errors and vice versa.

Since the elements of H are generally frequency-dependent, it may be desirable to use different values of n at different frequencies. To avoid discontinuities in the elements of $\tilde{E}$ at frequencies where n changes, an alternative process might be preferable. In this process, instead of inverting the n largest singular values, construct the matrix $\Sigma^{+}$ by assigning the following value to each diagonal element:

$$\Sigma_i^{+}=\frac{1}{\Sigma_i}e^{-g/\Sigma_i}$$

In this case, varying the parameter g can similarly modulate the trade-off between stochastic and systematic errors, but in a continuous fashion.

Another method of reducing the stochastic errors at the expense of increased systematic errors is to use as encoding matrix $$\tilde{E}=H^{*}(HH^{*}+\lambda I)^{-1},$$

where $\lambda$ is a trade-off parameter and I is the identity matrix.

An embodiment of the invention would require the evaluation of each element of $\tilde{E}$ at a multitude of frequencies within the frequency band of interest. Through the use of an inverse Fourier transform one can obtain from each element of $\tilde{E}$ a time series which can be convolved with the input signals. This convolution may be carried out directly in the time domain or through the use of fast convolution, a well-known method for reducing the computational cost of convolution.

Because the values of $j_l(kr)$ vanish for low values of k and l>0, the corresponding elements of E will have very large values at low frequencies. Depending on the choices made in the calculation of $\tilde{E}$ this may also lead to large values in that matrix. This leads to infinite impulse responses. To find a short convolution kernel, the elements of $\tilde{E}$ must be modified before calculating the inverse Fourier transform. Suitable high-pass filters to apply to the elements of $\tilde{E}$ are $$T_l(k)=\left(\frac{ika}{ika+l}\right)^{l},$$

where a is a freely selectable size parameter, for example the radius of a circle inscribing the plate. To obtain the output values x with the correct low-frequency response, the inverse filters $T_l^{-1}(\bullet)$ can be implemented as recursive filters that are applied either before or after the finite convolution operation. However, due to sensor noise, this will result in unbounded noise energy at low frequencies, so a better solution might be to skip this step and instead redefine the output signals to incorporate the high-pass filters.

The process is summarized in FIG. 5, which shows the first step S1 of finding the response of microphone to each spherical harmonic mode H(k), the second step S2 of inverting the response matrix to find an exact or approximate encoding matrix E(K), the application S3 of the high-pass filters to the encoding matrix elements to obtain bounded transfer functions T(k) E(k) that can be converted through the use of an inverse Fourier transform in Step S4 into time-domain convolution kernels h(t).

FIG. 6 shows a convolution matrix unit CMU providing an implementation of the convolution matrix which converts the sensor inputs to the 3D wave field representation. The inputs IN to the convolution matrix unit CMU deliver the digitized sensor signals, which are fed to convolution units CON, whose outputs are summed to produce the output signals OUT from the convolution matrix unit CMU. The convolution kernels in the convolution units CON can be identical to the ones obtained through the process described in FIG. 5.

All of the functions that are being discussed here, and hence the encoding matrix $\tilde{E}$, are dependent on the speed of sound which in turn is dependent on environmental factors, including temperature. Depending on the size, frequency range and temperature range, an embodiment of the invention might therefore need a means of measuring the speed of sound and a means of altering $\tilde{E}$ accordingly.

One method of measuring the speed of sound is to include in the embodiment a transducer which emits sound or ultrasound. By measuring the phase relation between the emission from the transducer and reception at the multitude of microphones in the arrays, the speed of sound can be deduced. Another method of measuring the speed of sound is to include in the embodiment a thermometer unit and deduce the speed of sound from the known relation between temperature and speed of sound in the medium where the microphone array is used.

One method of altering $\tilde{E}$ according to the speed of sound is to include in the embodiment a computation device able to perform the disclosed calculation of E and to repeat these calculations regularly or as necessary when the temperature changes. One example of a suitable computation device is a stored-program computer according to the von Neumann architecture, programmed to perform the disclosed calculations. Another method of altering $\tilde{E}$ according to the speed of sound is to include in the embodiment an interpolation and extrapolation unit connected to a storage unit containing a multitude of instances of $\tilde{E}$, each calculated according to the disclosed methods for a different temperature.

When the shape and physical properties of the plate are circularly symmetric about the z axis, as exemplarily shown in FIGS. 2 and 3, the pressure contribution on the first surface of the plate due to scattering and vibration is of the form $$F_l^m(\theta,k,r)=Ne^{im\phi}P_{l+1}^m(0)f_l^m(k,r).$$

In other words, it is separable into an angular part and a radial part, where the angular part is equal to that of the incident field. The pressure contribution on the second surface will be $-F_l^m(\bullet)$. The functions $H_{l,j}^m(k)$, combining the response due to the incident field, scattered field and vibration, are in this case $$H_{l,j}^m(k)=Ne^{im\phi_j}[P_l^m(0)j_l(kr_j)+s_jP_{l+1}^m(0)f_l^m(k,r_j)],$$

where $s_j$ is 1 or −1, depending on which surface microphone j is on. The separability and z-symmetry of these functions allow, given a judicious placement of the microphones, for a decomposition of the matrix H into block-diagonal matrices which in turn will allow of a decomposition of the encoding matrix $\tilde{E}$ into block-diagonal matrices which in turn allows a reduction in the computational cost of calculating x.

Placing the microphones in rings that are concentric with the plate and with even spacing between microphones, we can calculate the angular Fourier transform of the signals from the microphones on each ring. In the following, we consider the signals from one ring only, bearing in mind that there may be more than one ring, each processed in the same manner:

$$\hat{H}_{l,n}^m(k)=\frac{1}{M}\sum_{j=0}^{M-1}e^{-i2\pi njl/M}H_{l,j}^m(k),$$

Inserting for $H_{l,j}^m(\bullet)$ yields $$\hat{H}_{l,n}^m(k)=\frac{1}{M}\sum_{j=0}^{M-1}e^{-i2\pi njl/M}e^{j2\pi mj/M}N[P_l^m(0)j_l(kr)+s_jP_{l+1}^m(0)f_l^m(k,r)],$$

where M is the number of microphones in the ring, r is the radius of the ring and the microphones within the ring are numbered j, running from 0 to M-1. The equation contains two frequencies, n and m, where m is the order of the wave field and n is the order of the response function, an integer in the range [0, M-1]. Due to aliasing, these are not necessarily equal, but we can still use the orthogonality of the complex exponentials to simplify the equation:

$$\hat{H}_{l,n}^m(k)=N\delta_{n,m'}[P_l^m(0)j_l(kr)+s_jP_{l+1}^m(0)f_l^m(k,r)],$$

where the aliased order of the incident wave field is defined as $$m'=m \bmod M.$$

A reduction in calculation cost follows because the Fourier transform which is involved is frequency-independent and because the resulting matrix $\hat{H}$ has mostly zero-valued elements, leading to a similar proportion of zero-valued elements in $\tilde{E}$.

Further reduction in calculation cost can be achieved by combining signals from rings at the same radius, but on opposite sides of the plate. We will refer to this type of placement as a directly opposing concentric ring placement. According to this placement, the microphones in each array are placed in rings that are concentric with the plate and with even spacing between microphones. The microphone arrays on the two surfaces of the plate are identical in this type of placement, such that each individual sensor in one of the arrays is directly opposite an individual sensor in the other array. This arrangement is illustrated by way of example in FIG. 2, where the sensors, e.g. microphones, on the top side are directly opposite the sensors, e.g. microphones, on the bottom side.

We define $\hat{H}_{l,n,1}^m(\bullet)$ as the signals $\hat{H}_{l,n}^m(\bullet)$ computed from a ring of sensors on the top surface and $\hat{H}_{l,n,-1}^m(\bullet)$ as the signals $\hat{H}_{l,n}^m(\bullet)$ computed from a ring of sensors on the bottom surface, both rings having the same radius.

We further define the functions $$\hat{H}^m_{l,n,\Sigma}(k) = \frac{1}{2}\left[\hat{H}^m_{l,n,1}(k) + \hat{H}^m_{l,n,-1}(k)\right]$$

$$\hat{H}^m_{l,n,\Delta}(k) = \frac{1}{2}\left[\hat{H}^m_{l,n,1}(k) - \hat{H}^m_{l,n,-1}(k)\right]$$

Inserting for $\hat{H}_{l,n,\pm 1}{}^m(\bullet)$ we get $$\hat{H}_{l,n,\Sigma}{}^m(k)=N\delta_{n,m}P_l{}^m(0)j_l(kr)$$

$$\hat{H}_{l,n,\Delta}{}^m(k)=N\delta_{n,m}P_{l+1}{}^m(0)f_l^m(k,r)$$

Only the even $\hat{H}_{l,n,\Sigma}{}^m$ functions are non-zero and only the odd $\hat{H}_{l,n,\Delta}{}^m$ functions are non-zero, where even and odd refers to the parity of l+m. Due to the linearity of the Fourier transform, the method described above can be applied either directly to the time domain signals acquired from the sensors, or to frequency domain signals acquired as part of a fast convolution operation.

Depending on the production process and geometry of the microphones, it may be impractical to place microphones precisely opposite each other. Instead, we rotate the arrays on the two surfaces of the plate by an angle±α about the z axis, resulting in a rotation angle of 2α between the two arrays. Now, for each ring we have $$\hat{H}^m_{l,n,\pm 1}(k) = \frac{1}{M}\sum_{j=0}^{M-1} e^{-i2\pi nj/M} e^{im\left(\frac{2\pi j}{M}\pm\alpha\right)} N[P_l^m(0)j_l(kr) \pm P_{l+1}^m(0)f_l^m(k,r)],$$

$$\hat{H}^m_{l,n,\pm 1}(k) = \delta_{n,m'} e^{\pm im\alpha} N[P_l^m(0)j_l(kr) \pm P_{l+1}^m(0)f_l^m(k,r)].$$

To compensate for the phase shift $e^{\pm im\alpha}$ associated with the rotation of the arrays, we introduce an opposite phase term when calculating $\hat{H}_{l,n,\Sigma}{}^m(\bullet)$ and $\hat{H}_{l,n,\Delta}{}^m(\bullet)$. However, we are only free to choose this term as a function of n, meaning that the phase shift will only correctly compensate for the rotation in the non-aliased components of H for a general value of α.

$$\hat{H}^m_{l,n,\Sigma}(k) = \frac{1}{2}\left[e^{-ina}\hat{H}^m_{l,n,1}(k) + e^{ina}\hat{H}^m_{l,n,-1}(k)\right]$$

$$\hat{H}^m_{l,n,\Delta}(k) = \frac{1}{2}\left[e^{-ina}\hat{H}^m_{l,n,1}(k) - e^{ina}\hat{H}^m_{l,n,-1}(k)\right]$$

Again, inserting for $\hat{H}_{l,n,\pm 1}{}^m(\bullet)$ we get $$\hat{H}_{l,n,\Sigma}{}^m(k)=N\delta_{n,m}P_l{}^m(0)j_l(kr)\cos(m-n)\alpha+N\delta_{n,m}P_{l+1}{}^m(0)f_l^m(k,r)\sin(m-n)\alpha$$

$$\hat{H}_{l,n,\Delta}{}^m(k)=N\delta_{n,m}P_{l+1}{}^m(0)f_l^m(k,r)\cos(m-n)\alpha+N\delta_{n,m}P_l{}^m(0)j_l(kr)\sin(m-n)\alpha$$

Due to aliasing, m and n are not necessarily identical, but may differ by an integer multiple of M, meaning that we generally have to keep both terms in these equations. However, choosing a rotation angle equal to $$\alpha = \frac{\pi}{2M}$$

ensures that either $$\sin(m-n)\alpha=0$$

or $$\cos(m-n)\alpha=0$$

whenever n=m', which are the only cases where the $\delta_{n,m'}$ term is non-zero. Thus we end up with the same number of zero-valued terms as when the microphones were placed directly opposite each other. We will refer to this type of placement as a staggered concentric ring placement. This arrangement is illustrated by way of example in FIG. 3, where the sensors, e.g. microphones, on the top side are staggered relative to the microphones on the bottom side.

For compactness in the description, we have chosen to phase shift the signals from the top and bottom rings by opposite amounts. In an embodiment of the invention it would suffice to phase shift the signals from only one side of the plate by twice the amount.

FIG. 7 exemplarily illustrates the process just described when applied to a single double-sided ring. Signals from sensors TSS on the top surface and signals from sensors BSS on the bottom surface are each transformed, by an angular Fourier Transform Unit AFU, into components associated with different aliased orders. The components from one of the surfaces are phase shifted by a phase shift unit PSU and the resulting components from the top and bottom surfaces are summed by a summing unit SUM and subtracted by a Difference Unit DIF in order to produce even outputs EO and odd outputs OO.

Hence in an exemplary embodiment of the invention a three-dimensional (3D) wave field representation even and odd output signals of a 3D wave field are determined using a plate that is are circularly symmetric with at least one pair of circular microphone arrays of a same radius on each of the oppositely facing planar sides of the plate. Each microphone ring is concentric with the plate wherein said wave field representation consists of a multitude of time-varying coefficients. The method comprises transforming signals from microphones of one of the arrays of the pair and signals from sensors on the other of the arrays of the pair, by an angular Fourier transform, into components associated with different aliased orders; phase shifting the transformed signals from the one array; determining the even output signals by summing up the resulting components from the one and the other array and determining the odd output signals by subtracting, from the resulting components of the one array, the resulting components of the other array.

In case of more than one pair, each pair produces a series of output signals of which each can be associated with a unique combination of parity and order. Among the signals with same order, odd output signals from different pairs of circular sensor arrays can be convolved and even output signals from different pairs of circular sensor arrays can be convolved to produce a series of outputs.

FIG. 8 exemplarily illustrates how the outputs from double-sided rings of different radii can be combined to construct the 3D wave field representation. Each double-sided ring DSR, comprising the elements illustrated in FIG. 7, produces a series of output signals, each associated with a unique combination of parity and order. Output signals from different double-sided rings DSR, i.e. sensor ring pairs on the oppositely facing sides having different radii having odd parity and same order are routed to the same odd convolution matrix unit OCM which produces a series of outputs OO. Output signals from different double-sided rings DSR having even parity and same order are routed to the same even convolution matrix unit ECM produces a series of outputs EO. Each of the convolution matrix units ECM, OCM has an internal structure as illustrated in FIG. 6.

The number of microphones within each ring determines the maximum order which can be unambiguously detected by the array.

The number of rings is related to the number of different degrees that can be unambiguously detected. The relation is that N rings give access to 2N degrees, since a given combination of order and parity only occurs for every second degree. Is should be noted, however, that this does not imply than N rings always suffice to produce output signals up to 2N degrees. Even if we are only interested in the first 2N degrees, higher-degree modes may be present in the input signals and without a sufficient number of rings it will not be possible to suppress them from the output signals.

For broadband applications, it is beneficial to place the inner rings closer to each other than the outer rings. The optimal radii of the different rings depend on the plate shape and frequency band of interest and can be determined through computer optimization.

In embodiments of the invention where no wave sensors are present at the center of the device, this location can advantageously but not necessarily be used to locate an image acquisition system having nearly the same center point as the sensor array. The image acquisition system consists of an image sensor which is co-planar with the rigid plate and a lens. In some embodiments of the invention, one image acquisition system is located on each of the two surfaces of the rigid plate.

There exist microphones that are intended for PCB mounting where the acoustic port is on the bottom side of the microphone enclosure, and where a hole in the PCB underneath the microphone enclosure is used to lead sound from the opposite side of the PCB into the acoustic sensor. For the purposes of this description and the claims, the surface that a sensor is located on is intended to refer to the side of the plate on which the sensor senses.

In general, the foregoing describes only some exemplary embodiments of the present invention, and modifications and/or changes can be made thereto without departing from the scope of the invention as set forth in the claims.

The invention claimed is:

1. A signal acquisition device for acquiring three-dimensional wave field signals within a range of frequencies, the signal acquisition device comprising:

a single wave-reflective plate comprising two planar sides facing oppositely without a gap therebetween and a two-dimensional array of omnidirectional sensors arranged on one of the two sides, wherein the signal acquisition device comprises another two-dimensional array of omnidirectional sensors arranged on the other of the two sides, and at least more than 50% of all sensors of the signal acquisition device are arranged on the single wave-reflective plate, and wherein the wave-reflective plate is rigid.

2. The signal acquisition device according to claim 1, where all sensors are in direct contact with the single wave-reflective plate.

3. The signal acquisition device according to claim 1, wherein the plate has material properties such that it reflects at least 10% of the energy of that part of a plane wave in the range of frequencies which impinges on it at normal angle.

4. The signal acquisition device according to claim 1, wherein the plate has a thickness between 2 mm and 5 mm.

5. The Signal acquisition device according to claim 1, wherein the plate is acoustically hard and the signal acquisition device is configured for determining even and odd modes of a 3D wave field by determining sums and differences between signals derived from each of the two two-dimensional arrays.

6. The signal acquisition device according to claim 1, wherein the shape of the plate is circularly symmetric, such as a circular disc.

7. The signal acquisition device according to claim 1, wherein the sensors are placed according to any of the following placement types:

a. a directly opposing concentric ring placement on the opposing planar sides of the plate and b. a staggered concentric ring placement on the opposing planar sides of the plate.

8. The signal acquisition device according to claim 1, wherein the sensors are configured for acquiring at least one of acoustic signals, radio frequency wave signals, and microwave signals.

9. The signal acquisition device according to claim 1, wherein the plate comprises a printed circuit board and wherein the sensors are microphones that are mounted on the printed circuit board.

10. The signal acquisition device according to claim 1, further comprising a digital signal processor configured for digitizing sensor signals acquired using the array and the another array of sensors.

11. The signal acquisition device according to claim 10, wherein the digital signal processor is further configured for computing a 3D wave field representation of the 3D wave field by multiplying a matrix of linear transfer functions with a vector consisting of the digitized sensor signals.

12. The signal acquisition device according to claim 11, wherein the digital signal processor is further configured for multiplying each of a multitude of block-diagonal matrices with the vector of 3D wave field signals in sequence.

13. The signal acquisition device according to claim 11, further comprising means for measuring a speed of sound, wherein the digital signal processor is configured for altering the matrix of linear transfer functions in accordance with the speed of sound.

14. The signal acquisition device according to claim 10, wherein the digital signal processor comprises a field-programmable gate array.

15. The signal acquisition device according to claim 10, wherein at least one image acquisition system is located at the center of the sensor array, each of the image acquisition systems comprising a lens and an image sensor, the image sensor characterized in that it is co-planar with the plate.

16. A method for constructing a three-dimensional (3D) wave field representation of a 3D wave field using a signal acquisition device according to claim 1, the wave field representation consisting of a multitude of time-varying coefficients and the method comprising:

a. acquiring sensor signals using the array and the another array of sensors;

b. digitizing the acquired sensor signals; and c. computing a 3D wave field representation of a 3D wave field by multiplying a matrix of linear transfer functions with a vector consisting of the digitized sensor signals.

17. The method according to claim 16, further comprising determining even and odd modes of the 3D wave field by determining sums and differences between signals derived from each of the two two-dimensional arrays.

18. The method according to claim 16, wherein step c comprises:

obtaining a response matrix of the sensors to each of a plurality of spherical harmonic modes, obtaining an encoding matrix by inverting the response matrix, obtaining bounded transfer functions by filtering elements of the encoding matrix using high-pass filters, and obtaining time-domain convolution kernels by converting the bounded transfer functions using an inverse Fourier transform.

19. The method according to claim 16, wherein the multiplication with the matrix of linear transfer functions is performed by decomposing the matrix of linear transfer functions into a product of a multitude of block-diagonal matrices of linear transfer functions and multiplying each of the block-diagonal matrices with the vector of 3D wave field signals in sequence.

20. The method according to claim 16, wherein the constructed 3D wave field representation is used for any of the following applications:

a. Active noise cancellation;

b. Beamforming;

c. Direction of arrival estimation; and d. Sound recording or reproduction.

* * * * *